United States Patent [19]

Taylor et al.

[11] 4,420,178

[45] Dec. 13, 1983

[54] REMOVABLE FIXING DEVICE

[75] Inventors: Gerald M. Taylor, Harpenden; Norman R. Emms, Welwyn Garden City, both of England

[73] Assignee: Item Products Limited, London, England

[21] Appl. No.: 318,864

[22] Filed: Nov. 6, 1981

[30] Foreign Application Priority Data

Nov. 10, 1980 [GB] United Kingdom ..... 8036056

[51] Int. Cl.[3] ..... B65D 71/00

[52] U.S. Cl. ..... 294/158; 294/16; 229/52 A

[58] Field of Search ..... 294/158, 16, 137, 145, 294/149, 170, 27 H, 32, 31.2, 31 A, ; 16/114 A; 229/52 A

[56] References Cited

U.S. PATENT DOCUMENTS

| | | | |
|---|---|---|---|
| 1,958,587 | 5/1934 | Mitchell et al. | 294/158 |
| 3,124,993 | 3/1964 | Schlueter | 85/1 |
| 3,136,017 | 6/1964 | Prezlosi | 24/221 |
| 3,215,006 | 11/1965 | Urani | 294/16 |
| 4,035,097 | 7/1977 | Bachand | 403/348 |

FOREIGN PATENT DOCUMENTS

| | | |
|---|---|---|
| 873245 | 7/1961 | United Kingdom . |
| 874712 | 8/1961 | United Kingdom . |
| 916457 | 1/1963 | United Kingdom . |
| 1249646 | 10/1971 | United Kingdom . |
| 1254846 | 11/1971 | United Kingdom . |
| 1293854 | 10/1972 | United Kingdom . |
| 1458143 | 12/1976 | United Kingdom . |

*Primary Examiner*—James B. Marbert

*Attorney, Agent, or Firm*—Hopgood, Calimafde, Kalil, Blaustein & Judlowe

[57] ABSTRACT

A removable fixing device for use with an article having a slot, comprising twisting means, for example in FIG. 1 a handle portion 2, and two outwardly projecting and outwardly open clips *7a* and *7b*. In use, the clips *7a* and *7b* are aligned with and between adjacent edges of a slot formed in the article and the handle portion 2 is twisted so as to cause the clips *7a* and *7b* to grip opposed edge portions of the slot.

10 Claims, 2 Drawing Figures

REMOVABLE FIXING DEVICE

FIELD OF THE INVENTION

The present invention relates to a removable fixing device which locks when twisted for use with an article having a slot.

Such a removable fixing device has many and varied possible applications.

SUMMARY OF THE INVENTION

According to the present invention there is provided a removable fixing device for use with an article having a slot, comprising:

a plurality of outwardly projecting clips and;

means to enable twisting of the clips;

the device being so constructed that it may be fastened to the article by positioning the device with each said clip generally aligned with and between opposed slot edges and by then twisting the clips by means of the twisting means so as to permit each clip to receive and grip therein opposed slot-defining edge portions of the article.

A preferred feature of the invention is that upper and lower interior surfaces of the clips are furnished with projection such as spaced ribs to ensure a firm grip of the clip on the said opposed slot-defining edge portions. The number of ribs and the spacing between the upper and lower interior surfaces of the clips can be varied according to the intended use of the device.

One possible embodiment of the invention is a removable twist-lock carrying handle comprising a handle portion which also provides the means for twisting the device. Such a removable carrying handle could be of use in a warehouse or retail store for transporting cardboard cartons and the like.

Another embodiment of the invention is a removable holding device. Such a device could be fastened by means of a slot in one face of the display package of an article for sale and utilised to position the article within the package thereby obviating the need for specially configured cardboard portions within the package, commonly used to perform this function. Many other uses of such a holding device are envisaged.

BRIEF DESCRIPTION OF THE DRAWINGS

Two particular embodiments of the invention will now be described by way of example with reference to the accompanying drawings wherein.

DESCRIPTION OF THE PREFERRED EMBODIMENTS

Figure 1:
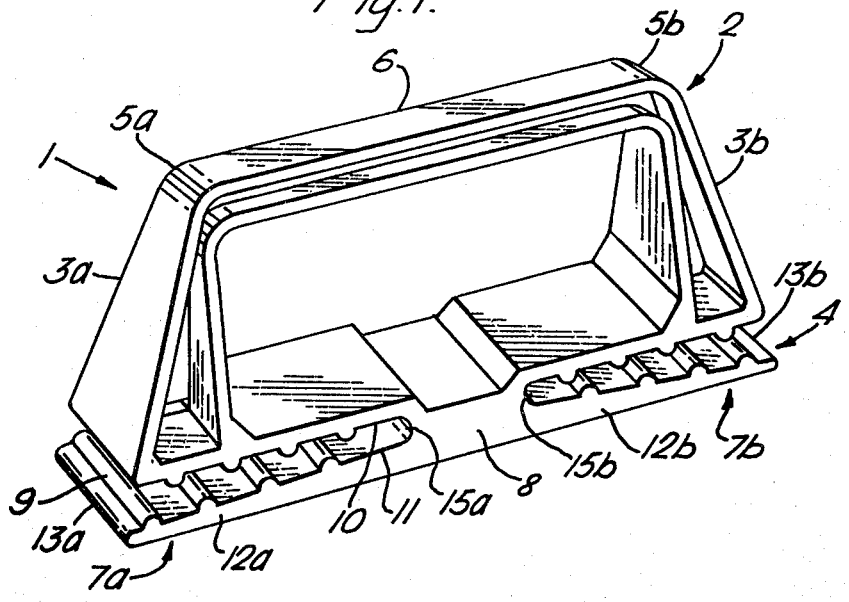
FIG. 1 is a perspective view of a removable carrying handle.

Referring first to FIG. 1, a removable carrying handle is generally indicated at 1.

An upper handle portion 2 comprises two sections 3*a* and 3*b* extending vertically from opposite ends of and contiguous with the base 4, the two sections 3*a* and 3*b* gradually narrowing towards their uppermost parts 5*a* and 5*b* and a bar 6 of a uniform cross-section extending horizontally between the upper ends 5*a* and 5*b* of the two vertical sections and contiguous with said upper ends.

The lower locking base portion 4 is elongate and comprises two similar outwardly open clips 7*a* and 7*b* projecting outwardly in opposite directions from a central portion 8 of the base.

The clips 7*a* and 7*b* are furnished with semicylindrical spaced ribs 9 on their upper interior surface 10 and their lower interior surface 11. The ribs on the upper interior surface 10 are slightly laterally displaced from the corresponding ribs on the lower interior surface 11.

The lower limbs 12*a* and 12*b* of each of the clips 7*a* and 7*b* are of tapering thickness, being thinnest at their outermost ends 13*a* and 13*b*. Consequently, the spacing between the upper interior surface 10 and the lower interior surface 11 of each clip gradually increases outwardly.

The width of the central portion 8 of the base defines the distance between innermost edges 15*a* and 15*b* of the clips 7*a* and 7*b*.

In use, the removable carrying handle illustrated in the accompanying drawing is placed lengthways in the slot constituted by the elongate opening in the lid of a carton and is then twisted through 90° so that the edges of the flaps comprising the lid of the carton are gripped in the removable carrying handle clips 7*a* and 7*b*, one flap being retained in each clip. It will be understood that the slot may be one specially formed elsewhere in a face of the carton.

The slight lateral spacing of corresponding ribs 9 on the upper and lower interior surfaces, 10 and 11 respectively, of the clips 7*a* and 7*b* causes a crimping action to be applied to the lid flaps of the carton enabling them to be gripped more securely.

Ideally, when the removable carrying handle is in the locked position, the flaps of the carton lid should be retained within substantially the whole length of the two clips 7*a* and 7*b* to ensure a good grip. It may be necessary to remove a length of carton material adjacent to the elongate opening to compensate for the lateral spacing between the two innermost edges 15*a* and 15*b* of the clips 7*a* and 7*b* respectively of the removable carrying handle.

To unlock the removable carrying handle it is turned through 90° so that it is again situated lengthways in the elongate opening of the carton lid no longer gripping the flaps of the carton lid and easily removable.

The removable carrying handle as herein described may be made entirely of plastics material and may be injection moulded.

Figure 2:
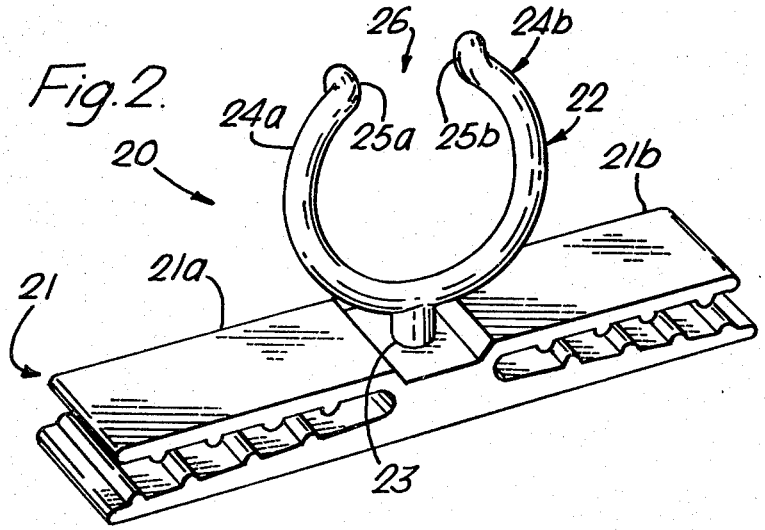
FIG. 2 is a perspective view of a removable holding device.

Referring now to FIG. 2, there is shown a removable holding device indicated generally at 20.

The base 21 of the holding device 20 comprises two outwardly open clips 21*a* and 21*b*. These are identical to the clips 7*a* and 7*b* of FIG. 1 and therefore will not be redescribed. The upper portion of holding device 20 comprises a retaining member 22 specifically configured to position the particular article in question. Retaining member 22 has a substantially cylindrical support 23 contiguous with the base 21 and two upwardly extending arms 24*a* and 24*b*. The uppermost ends of arms 24*a* and 24*b* are formed with rounded heads 25*a* and 25*b* which form a neck 26 through which the article to be positioned can pass. Resilient flexing of arms 24*a* and 24*b* facilitates secure positioning of the article.

In use, the clips 21*a* and 21*b* are aligned with and between the edges of a slot in one face of a display package and using the retaining member 22, the device is rotated through 90° so that the clips 21*a* and 22*b* firmly grip edge portions of the slot and thereby fasten the device to the package. The article to be positioned is inserted through neck 26 and held in position by arms 24*a* and 24*b*. Removal of the device is effected simply by again rotating through 90° so that the clips 21*a* and 21*b* no longer grip edge portions of the slot.

Of course the exact configuration of the retaining member 22 is governed by the intended use of the holding device 20 and it can be of various shapes.

The present invention can be utilised in a variety of ways, for example removable wall hooks comprising clips as shown in FIGS. 1 and 2 could easily be attached to a partition utilising a slot therein and would obviate the need for screws or other securing means. Another possible application is to marking devices for holiday charts or the like wherein each marking device would comprise a base having a plurality of outwardly projecting clips, similar to those previously described, and the devices could be attached or removed at will using slots provided in the chart.

We claim:

1. A removable carrying handle for use with an article having a slot, comprising:

a plurality of outwardly projecting clips, each clip comprising an upper interior surface and a lower interior surface and;

handle means to enable twisting of the clips;

the device being so constructed that it may be fastened to the article by positioning the device with each said clip generally aligned with and between opposed slot edges and by then twisting the clip by means of the handle means so as to permit substantial portions of the upper and lower interior surfaces of each clip to receive and grip therein opposed slot-defining edge portions of the article.

2. A removable fixing device according to claim 1, comprising two clips opening outwardly in opposite directions.

3. A removable fixing device according to claim 1 or claim 2, wherein each clip comprises an upper limb and a lower limb.

4. A removable carrying handle according to claim 1, wherein upper and lower interior surfaces of the clips comprise a plurality of projections to improve gripping ability.

5. A removable carrying handle according to claim 4, wherein the projections are semi-cylindrical ribs.

6. A removable carrying handle according to claim 5, wherein in each clip the ribs on the upper interior surface are slightly laterally displaced from corresponding ribs on the lower interior surface.

7. As an article of manufacture, an integrally formed single-piece carrying handle removably attachable via quarterturn twist to a container or the like wall having an elongate slot therein, said article comprising an elongate body of relatively narrow H-configuration enterable in the slot and defining first and second pairs of upper and lower clip arms connected to each other centrally of said body and extending in opposite directions, and a handle formation interconnecting the upper clip arms and spanning the central region of said body.

8. The article of claim 7, in which opposed inner surfaces of said clip arms have ribbed wall-gripping formations, wherein ribs of one surface are in longitudinal interlace with ribs of the other surface.

9. As an article of manufacture, an integrally formed single-piece mounting device removably attachable via quarterturn twist to a container or the like wall having an elongate body of relatively narrow H-configuration enterable in the slot and defining first and second pairs of upper and lower clip arms connected to each other centrally of said body and extending in opposite directions, and a mounting device integrally formed with said body on the side of one of the arms of each of said pairs.

10. The article of claim 9, in which opposed inner surfaces of said clip arms have ribbed wall-gripping formations, wherein ribs of one surface are in longitudinal interlace with ribs of the other surface.

* * * * *